US012576301B1

(12) United States Patent
Stearns

(10) Patent No.: US 12,576,301 B1
(45) Date of Patent: Mar. 17, 2026

(54) RESISTANCE BRAKE DEVICE FOR AN EXERCISE MACHINE

(71) Applicant: Kenneth W Stearns, Houston, TX (US)

(72) Inventor: Kenneth W Stearns, Houston, TX (US)

( * ) Notice: Subject to any disclaimer, the term of this patent is extended or adjusted under 35 U.S.C. 154(b) by 36 days.

(21) Appl. No.: 18/629,911

(22) Filed: Apr. 8, 2024

Related U.S. Application Data

(60) Provisional application No. 63/458,080, filed on Apr. 7, 2023.

(51) Int. Cl.
*A63B 21/00* (2006.01)

(52) U.S. Cl.
CPC ..... *A63B 21/158* (2013.01); *A63B 21/00069* (2013.01); *A63B 2225/66* (2013.01)

(58) Field of Classification Search
CPC ..... A63B 21/158; A63B 21/00069; A63B 2225/66
See application file for complete search history.

(56) References Cited

U.S. PATENT DOCUMENTS 3,970,302 A * 7/1976 McFee ..... A63B 22/0056 482/53
5,183,449 A * 2/1993 DeCloux ..... A63B 22/0056 482/53

* cited by examiner

*Primary Examiner* — Andrew S Lo

(57) ABSTRACT

An exercise resistance device operably connected to reciprocating members of an exercise machines may include a closed fluid flow system enclosed in an inner housing. Reciprocal movement of the reciprocating members alternately rotates a drive gear and driven gear in clockwise and counterclockwise directions pumping fluid from a low pressure fluid passagewayway into a high pressure fluid passagewayway of the closed fluid flow system. A spool valve is movable to maintain a heat exchanger and flow control valve in fluid communication with the high pressure fluid flow passageway regardless of the rotation direction of the drive gear and driven gear. Adjustment of a flow control valve adjusts the speed/resistance of the exercise machine. An outer housing partially enclosing the inner housing provides containment of fluid leaks.

12 Claims, 3 Drawing Sheets
(2 of 3 Drawing Sheet(s) Filed in Color)

RESISTANCE BRAKE DEVICE FOR AN EXERCISE MACHINE

CROSS-REFERENCE TO RELATED APPLICATION

This application claims priority to and the benefit of the filing date of U.S. Provisional Application Ser. No. 63/458,080, filed Apr. 7, 2023, which application is herein incorporated by reference in its entirety.

BACKGROUND

The present invention relates to an adjustable resistance brake device for use on an exercise machine with reciprocating motion.

Exercise resistance devices for exercise machines have taken many forms including, but not limited to, eddy current brakes, friction brakes, inertial brakes, hydraulic cylinders, and others. Linear hydraulic brakes currently available have several disadvantages such as requiring more space, resistance adjustments require the user to get off the machine to make the adjustments and requires two adjustments (one for each cylinder). Another concern with using hydraulics is potential fluid leaks that may drip on a user's floor, carpet, etc.

It is an object of the present invention to provide an exercise resistance device providing manual and/or remote adjustment to control the speed/resistance of the exercise machine.

It is another object of the present invention to provide an exercise resistance device including a heat exchanger for dissipating heat generating by the exercise resistance device.

It is yet another object of the present invention to provide an exercise resistance device including a housing configured to contain fluid that may leak from any components of the exercise device.

It is still another object of the present invention to provide an exercise resistance device that is relatively inexpensive to produce.

SUMMARY

An exercise resistance device operably connected to reciprocating members of an exercise machines may include a fluid reservoir, a flow control valve, a heat exchanger, a spool valve, an external gear pump, a lower fluid chamber in fluid communication forming a closed fluid flow system enclosed in an inner housing. A drive gear and a driven gear may be operatively connected to the reciprocating members of the exercise machine. Reciprocal movement of the reciprocating members alternately rotates the drive gear and driven gear in clockwise and counterclockwise directions to pump fluid from a low pressure fluid flow passageway into a high pressure fluid flow passageway. A spool valve movable to maintain the heat exchanger and flow control valve in fluid communication with the high pressure fluid flow passageway regardless of the rotational direction of the drive gear and driven gear. Adjustment of the flow control valve adjusts the speed/resistance of the exercise machine. An outer housing partially enclosing the inner housing provides containment of fluid leaks.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

Figure 1:
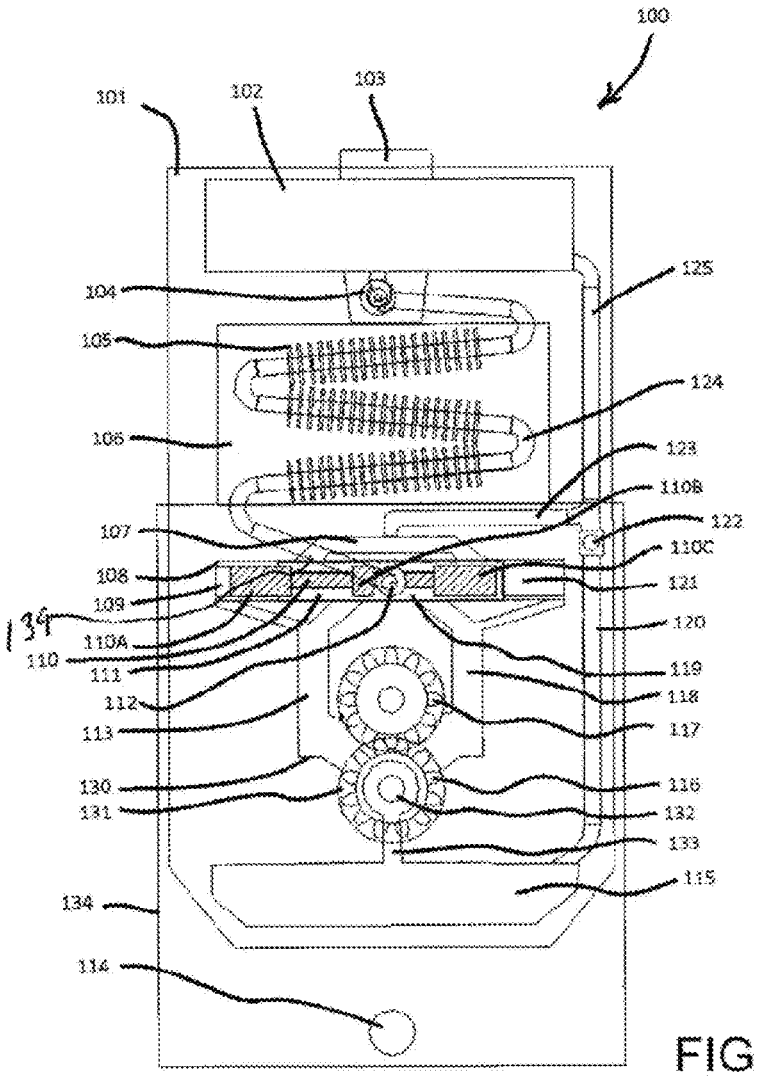

FIG. 1 is a diagram of an adjustable resistance brake device for an exercise machine.

Figure 2:
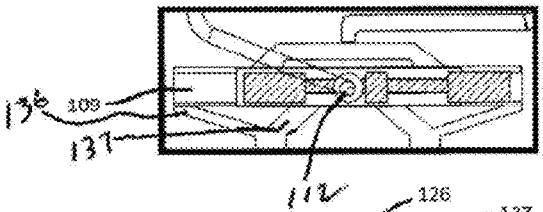

FIG. 2 is a diagram of the spool valve of the resistance brake device shown in FIG. 1.

Figure 3:
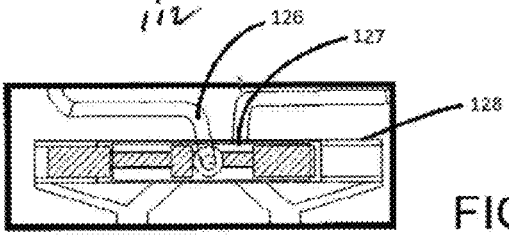

FIG. 3 is a diagram of an alternate arrangement of ports in the spool valve of the resistance brake device shown in FIG. 1.

Figure 4:
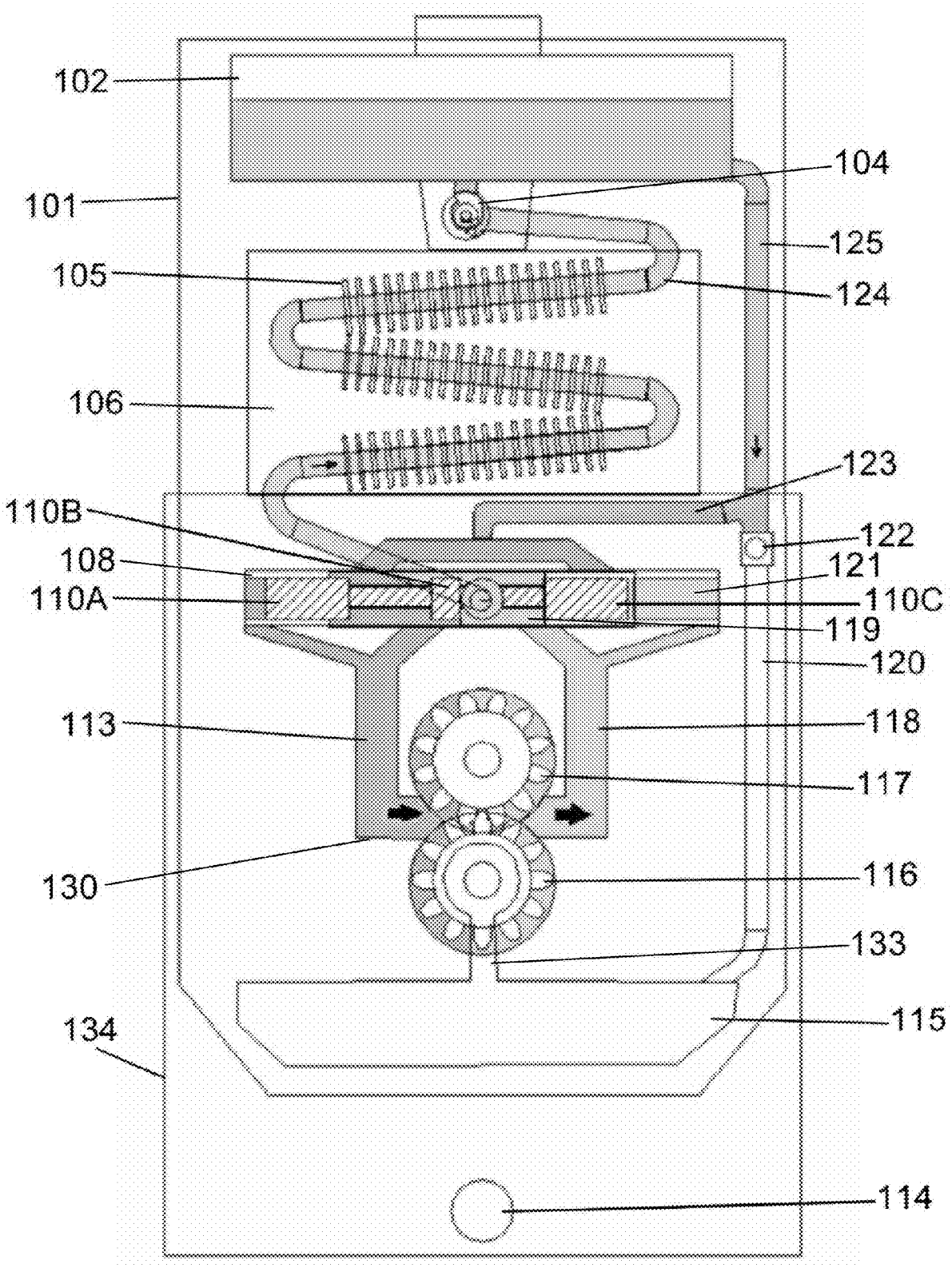

FIG. 4 is a color diagram illustrating fluid flow through the resistance brake device shown in FIG. 1. The high pressure fluid flow path is pink and low pressure fluid flow path is blue.

Figure 5:
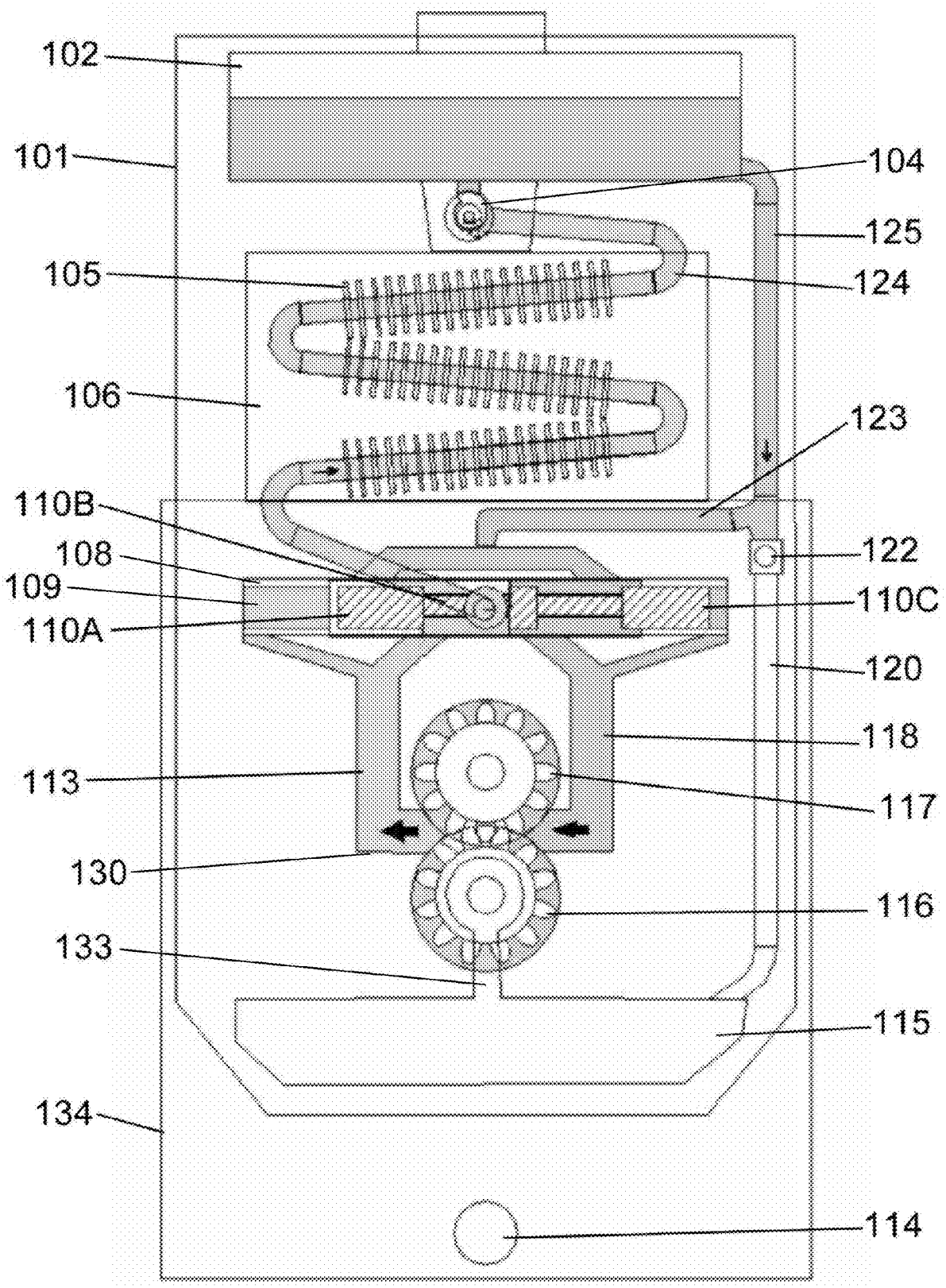

FIG. 5 is a color diagram illustrating reversal of the fluid flow path through the resistance brake device shown in FIG. 1. The high pressure fluid flow path is pink and low pressure fluid flow path is blue.

DETAILED DESCRIPTION

Referring first to FIG. 1, a resistance brake device for an exercise machine is generally identified by the reference numeral 100. The resistance brake 100 may include a housing 101 secured to an exercise machine by means known in the art. A fluid reservoir 102, a flow control valve 104, a heat exchanger 124, a spool valve 108, an external gear pump 130, and a lower chamber 115 housed within the housing 101 may be operatively connected to form a closed fluid flow system. A drive gear 116 may be connected through a drive shaft 132 to reciprocating members of an exercise machine (not shown in the drawings), including but not limited to, handlebars and foot support members, through one of various transmission means such as, but not limited to, pulleys, belts, chains and the like. Fluid may be added to the fluid reservoir 102 through a fill port 103.

During use of an exercise machine having reciprocating members, a user applied force to reciprocally move the reciprocating members may be transmitted to the drive gear 116 through a sprocket, pulley, gear, and other transmission means operatively connected to the drive gear 116. The reciprocal movement of the reciprocating members may rotate the drive gear 116 in clockwise and counterclockwise directions. Driven gear 117 rotates in the opposite direction of drive gear 116. Rotation of the drive gear 116 and driven gear 117 force fluid around the circumference of the drive gear 116 and driven gear 117 into fluid flow passageways 113 and 118 of the pump 130.

The direction of fluid flow through the pump 130 depends on the direction drive gear 116 and driven gear 117 rotate. In FIG. 1, the drive gear 116 rotation is counterclockwise and the driven gear 117 rotation is clockwise. Rotation of drive gear 116 and driven gear 117 pumps fluid from fluid flow passageway 113 around the circumference of the drive gear 116 and driven gear 117. The fluid is discharged into fluid flow passageway 118 at a higher pressure than the pressure in the fluid flow passageway 113.

The fluid in passageway 118 may be directed into spool valve 108 through port 119 and pilot port 121. High pressure fluid, shown in pink in FIG. 4, entering the spool valve 108 through the pilot port 121 causes the spool to move to the left so that the spool lands 110A, 110B and 110C are in the position shown in FIG. 1 and FIG. 4, thereby establishing fluid communication with the heat exchanger 124. Fluid entering spool valve 108 through the port 119 exits the spool valve 108 through port 112 into the heat exchanger 124. The fluid flows through the heat exchanger 124 to the flow control valve 104. The flow control valve 104 restricts the flow of the fluid circulating through the closed fluid flow system of the brake device 100, thereby applying a braking force to the reciprocal movement of the reciprocating members of the exercise machine. The flow control valve 104 may be adjusted manually and by other means known in the art to control the speed/resistance of the reciprocating members of the exercise machine. Fluid exiting the flow control valve 104 enters reservoir 102 at a lower pressure. The lower pressure fluid flows into passageway 125 and then through passageway 123 and common passageway 107 to the spool valve 108. In the position of spool valve 108 shown in FIG. 1 and FIG. 4, fluid flows through common passageway 107 into spool valve area 111 through a port 139 and directed through fluid flow passageway 113 to the inlet port of the drive gear 116 and driven gear 117.

Reciprocating members of an exercise machine move in opposite direction relative to one another. For example, but not limited to, during a stepping exercise, one foot support member moves downward, and the opposite foot support member moves upward. The reciprocal movement of the foot support members rotate the drive gear 116 and driven gear 117 alternately clockwise and counterclockwise. When the drive gear 116 and driven gear 117 reverse their direction of rotation, the fluid flow path through the pump 130 reverses direction as shown in FIG. 5. High pressure fluid (pink fluid flow path in FIG. 5) pumped through fluid flow passageway 113 into the pilot port 109 of spool valve 108, shifts the spool valve to the right, positioning the spool lands 110A, 110B and 110C as shown in FIG. 5, thereby establishing fluid communication with the heat exchanger 124. In this position of the spool lands 110A, 110B and 110C, high pressure fluid entering the spool valve 108 from the fluid flow passageway 113 exits the spool valve 108 through port 112 into the heat exchanger 124.

The direction of fluid flow through the heat exchanger 124, flow control valve 104, reservoir 102 and fluid passageways 125, 123, and 107 does not change but remains the same regardless of the direction the drive gear 116 rotates. An advantage of having the spool valve circuitry as described herein is no matter which direction the reciprocating members and pump gears move heat may be continuously removed from the fluid through the heat exchanger 124.

Multiple sets of seals may be used to seal the drive gear shaft 132 to prevent fluid from leaking out of the pump 130. For example, but without limitation, fluid leaks may be blocked by a primary seal on the drive gear shaft 132. In the event fluid leaks past the primary seal, a secondary seal on the drive gear shaft 132 may direct fluid through passageway 133 into a lower chamber 115. The fluid reservoir 102 may be in fluid communication with the lower chamber 115. In the event the fluid level in the fluid reservoir 102 is low, the brake device may be turned upside down and a valve 122 opened to allow fluid to flow back through passageways 120 and 125 into the fluid reservoir 102. An alternate version may allow fluid from the lower chamber 115 to be pumped to the fluid reservoir 102 without turning the brake device upside down.

The housing 101 may include a region 106 that is open to the outside environment exposing the heat exchanger 124 to ambient air to aid cooling the fins 105 on the heat exchanger 124, and thereby enhancing the removal of heat from the fluid flowing into the fluid reservoir 102.

An optional fan may be driven by a pulley and the like connected to the drive gear 116 of the pump 130. Since the pulley will be constantly reversing direction, various fan arrangements may be employed whereby a constant stream of air may be directed over the heat exchanger 124. Also, a drive ratio may be determined whereby the fan blades spin at a higher velocity than the drive pulley.

In one embodiment of a cooling fan, means may be provided to reverse the direction of the blades thereby allowing a constant flow of air in one direction over the heat exchanger 124.

In an alternate embodiment, fluid that may leak out of the housing 101 may be contained by an outer housing 134 partially enclosing the housing 101. The drive shaft 132 may pass through the outer housing 134 sealed with, but not limited to, an O-ring seal. The outer housing 134 may be provided with a capped drain 114 for removal of fluid that may accumulate in the outer housing 134.

An optional arrangement of the fluid flow passageways connecting to the spool valve 108 is shown in FIG. 3. Common passageway 107 may be placed below the spool and connect to the outlet of the heat exchanger at port 127. Passageway 126 may connect to port 112 and to heat exchanger 124. A sleeve 128 may be used to isolate the fluid flow passageways thereby allowing all connections to be made internally.

The resistance brake device 100 and its parts may be fabricated of various materials, including but not limited to, plastics and metals, and copper for the heat exchanger 124 and aluminum for the fins 105. The parts may be molded, such as but not limited to, injection molding.

Other and further embodiments of a resistance brake device may include but is not limited to:

a) The fluid flow passageways, ports or parts shown in the drawings may be various sizes in proportion to the others.

b) Springs may be included at either or both ends of the spool valve.

c) One or more position indicators may be located on various parts of the resistance brake device including, but not limited to, the drive pulley and sprocket to indicate the distance traveled, speed and other factors of the user workout.

d) One or more pressure sensors may be employed to measure the amount of force created by the user to measure and read out the level of work performed.

e) Collected data of exercise parameters may be communicated to an onboard computer, a remote computer, a coach and other recording means for analysis, for example but without limitation, to evaluate a user's performance.

f) One or more pressure relief valves may be employed to monitor that high pressure fluid does not exceed a preset pressure limit when reversing the high/low fluid flow paths.

g) A pressure compensating membrane may be included in the fluid flow passageways to relieve momentary pressure increases during reversal of fluid flow through the spool valve.

While preferred embodiments of the invention have been shown and described, other and further embodiments of the invention may be devised without departing from the basic scope thereof, and the scope thereof is determined by the claims which follow.

The invention claimed is:

1. A resistance brake device for an exercise machine, comprising:

a) a housing;

b) a pump;

c) a heat exchanger;

d) a flow control valve;

e) a fluid reservoir;

f) wherein said pump, said heat exchanger, said flow control valve, and said fluid reservoir define a closed fluid flow system operatively connected to control speed/resistance of reciprocating members of the exercise machine.

2. The resistance brake device of claim 1 wherein said pump includes a high pressure fluid passageway and a low pressure fluid passageway, and further including a drive gear and a driven gear alternately rotatable clockwise and counterclockwise and operatively connected to the reciprocating members of the exercise machine.

3. The resistance brake device of claim 2 wherein rotation of said drive gear and said driven gear pumps fluid from said low pressure fluid passageway to said high pressure fluid passageway regardless of the rotational direction of said drive gear and said driven gear.

4. The resistance brake device of claim 3 further including a spool valve movable to maintain said heat exchanger and said flow control valve in fluid communication with said high pressure fluid passageway regardless of rotational direction of said drive gear and said driven gear.

5. The resistance brake device of claim 1 further including a chamber in fluid communication with said pump and said fluid reservoir.

6. The resistance brake device of claim 1 including means for adjusting the speed/resistance of the reciprocating members of the exercise machine.

7. The resistance brake device of claim 1 further including an outer housing partially enclosing said housing.

8. An exercise resistance brake device, comprising:

a) a housing;

b) a closed fluid flow system housed within said housing, said fluid flow system including at least:

(i) an external gear pump operatively connected to reciprocating members of an exercise machine;

(ii) a spool valve;

(iii) a heat exchange tube;

(iv) a flow control valve; and (v) a fluid reservoir;

c) said spool valve operable to maintain high pressure fluid flow to said flow control valve regardless of rotational direction of said gear pump.

9. The exercise resistance brake device of claim 8 wherein said fluid flow system includes a passageway interconnecting said fluid reservoir to said spool valve.

10. The exercise resistance brake device of claim 8 further including a chamber for collecting fluid leakage from said gear pump, and a passageway connecting said chamber to said fluid reservoir.

11. A brake system for adjusting the speed/resistance of reciprocating members of an exercise machine, comprising:

a) a closed fluid flow system including at least:

(i) an external gear pump operatively connected to the reciprocating members of the exercise machine;

(ii) a spool valve;

(iii) a heat exchange tube;

(iv) a flow control valve; and (v) a fluid reservoir;

b) said spool valve operable to maintain high pressure fluid flow to said flow control valve regardless of rotational direction of said gear pump.

12. The brake system of claim 11 wherein said fluid flow system includes a low pressure fluid passageway interconnecting said fluid reservoir to said spool valve.

* * * * *